US006184595B1

(12) United States Patent
Flegel, Jr.

(10) Patent No.: US 6,184,595 B1
(45) Date of Patent: Feb. 6, 2001

(54) INTERLOCK FOR TRANSVERSELY ORIENTED CIRCUIT BREAKER SWITCHES

(75) Inventor: David D. Flegel, Jr., Racine, WI (US)

(73) Assignee: Reliance Controls Corporation, Racine, WI (US)

( * ) Notice: Under 35 U.S.C. 154(b), the term of this patent shall be extended for 0 days.

(21) Appl. No.: 09/229,497

(22) Filed: Jan. 13, 1999

(51) Int. Cl.[7] ..... H01H 19/64
(52) U.S. Cl. ..... 307/114; 307/115; 307/125
(58) Field of Search ..... 200/50.33, 50.3, 200/331, 332, 50.14; 307/113, 115, 125; 395/500.16

(56) References Cited

U.S. PATENT DOCUMENTS

| | | |
|---|---|---|
| 3,158,701 | 11/1964 | Nadeau . |
| 3,198,898 | 8/1965 | Piteo, Jr. . |
| 3,647,997 | 3/1972 | Nerem . |
| 3,705,280 | 12/1972 | Harms . |
| 3,778,633 | 12/1973 | DeVisser et al. . |
| 4,270,031 | 5/1981 | Borona et al. . |
| 4,510,357 | 4/1985 | Winterbottom . |
| 4,665,284 | 5/1987 | Guinan . |
| 4,902,859 | 2/1990 | Witzmann et al. . |
| 4,906,958 | 3/1990 | Adamson . |
| 4,924,041 | 5/1990 | Yee . |
| 4,980,525 | 12/1990 | Kasisako . |
| 5,008,499 | 4/1991 | Yee et al. . |
| 5,109,142 | 4/1992 | VonKannewurff et al. . |
| 5,122,624 | 6/1992 | Benda . |
| 5,172,087 | 12/1992 | Castonguay et al. . |
| 5,189,385 | 2/1993 | Gnahn . |
| 5,268,543 | 12/1993 | Ramos . |
| 5,270,503 | 12/1993 | Frye . |
| 5,310,969 | 5/1994 | Turek et al. . |
| 5,322,980 | 6/1994 | Benda . |
| 5,648,646 | 7/1997 | Flegel . |
| 5,814,777 * | 9/1998 | Green et al. ..... 200/50.33 |

* cited by examiner

*Primary Examiner*—Stephen W. Jackson
*Assistant Examiner*—Sharon Polk
(74) *Attorney, Agent, or Firm*—Andrus, Sceales, Starke & Sawall, LLP

(57) ABSTRACT

An interlock for first and second circuit breaker switch mechanisms which respectively have first and second operating handles thereon oriented such that the direction of operation is transverse in relation to the other. The interlock includes an interlock mechanism disposed between the first and second switch mechanisms and includes a support, a first interlock member interconnected with the first operating handle, and a second interlock member interconnected with the second operating handle. The first and second interlock members are mounted to the support for movement relative to each other along with the respective first and second operating handles. The interlock members include interference structure to prevent the second switch mechanism from being in an ON position when the first switch mechanism is in its ON position and likewise to prevent the first switch member from being in an ON position when the second switch member is in its ON position. The interlock mechanism allows both switch mechanisms to be in an OFF position simultaneously. The interlock mechanism may be used to prevent simultaneous delivery of electrical power from two alternate sources.

22 Claims, 4 Drawing Sheets

INTERLOCK FOR TRANSVERSELY ORIENTED CIRCUIT BREAKER SWITCHES

FIELD OF THE INVENTION

This invention is generally related to an interlock for circuit breaker switches and, more particularly, pertains to a circuit breaker linkage assembly interlocking two opposing circuit breaker handles and preventing both circuit breakers from being ON at the same time.

BACKGROUND OF THE INVENTION

In today's electrical supply systems, there are occasions when alternate sources of electrical power are necessary or desirable. For example, the capability of switching from utility power to emergency generator power is very important for many businesses, hospitals and industries, and is also being employed in residential applications.

In certain applications, it is desirable for separate electrical circuits or even separate groups of electrical circuits to be arranged so that when one group of circuits is switched to a conductive state, another group of circuits is switched to a non-conductive state in alternating fashion. In some arrangements, it may be desirable to alternately switch a common load between separate power sources so that, as one power source is disconnected from the load, the second power source is connected to prevent interruption of power to the load. In order that the alternate switching may be effective essentially simultaneously, a need has been recognized to employ a coupling mechanism which functions to switch one circuit OFF as the other circuit is switched ON. Prior art interlocking systems provide an interlock for first and second aligned circuit breakers having first and second external operating handles oriented thereon such that the operating handles are parallel and disposed away from each other when the switches are OFF, and towards each other when the switches are ON. The interlock includes a linkage arrangement disposed across the face of the circuit breaker switches for applying a linear force between the first operating handle and the second operating handle. The linkage arrangement is formed such that pushing the first operating handle from an OFF position to an ON position pushes the second operating handle from an ON position to an OFF position. An example of an interlock of this type is disclosed in Flegel U.S. Pat. No. 5,648,646 issued Jul. 15, 1997.

The above-described interlock functions satisfactorily for switches which have parallel handles and which move along a common axis between their ON and OFF positions. However, it is common to feed utility or primary power to a load center through a main circuit breaker which is oriented perpendicularly to the branch circuit breakers. With this arrangement, the switch handle of the main circuit breaker moves between its ON and OFF positions in a direction perpendicular to the direction of movement of the branch circuit breaker switch handles. This construction prevents use of known prior art interlocks with the main circuit breaker, since known interlocks can only be used with aligned switch handles which move along a common axis.

It is thus desirable to provide an interlock mechanism which prevents two circuit breakers in nonparallel relation to each other, and possibly of different sizes, from being turned ON simultaneously. It is also desirable that the interlock mechanism permits both of the circuit breakers to be switched OFF at the same time.

Accordingly, it is an object of the present invention to provide a circuit breaker interlock which is useable when the circuit breakers have switches operational in transverse directions. A further object of the invention is to provide an interlock that prevents two power sources from supplying power to an electrical panel simultaneously. Yet another object of the invention is to provide an interlock that allows the circuit breakers to reside simultaneously in an OFF position so that no power is supplied to the electrical panel. Yet another object of the invention is to provide an interlock that is easily adaptable to commonly available circuit breakers and electrical panels. Yet another object of the invention is to provide an interlock which is relatively simple in its components and construction, and adaptable to other switching applications.

SUMMARY OF THE INVENTION

The present invention advantageously provides an interlock for circuit breakers installed in a standard electrical load center panel for the purpose of providing a safe and simple arrangement for providing power to the selected circuits from an alternate power source, such as a portable generator, during a utility power outage. The present invention enables the use of standard, off-the-shelf circuit breakers that, due to differences in size, construction and orientation when installed, cannot be arranged so that their handles more in the same direction.

In one aspect of the invention, an electrical panel has a first switch mechanism that is movable in a first direction, and a second switch mechanism movable in a second direction, non-parallel to the first direction. Both switches are operable between an ON and an OFF position, and are preferably associated with circuit breaker mechanisms which control the supply of electrical power to the electrical panel from a first or second power source, respectively. An interlock mechanism is interconnected between the first switch mechanism and the second switch mechanism to prevent movement of the second switch mechanism to an ON position when the first switch mechanism is in its ON position. The interlock mechanism also prevents movement of the first switch mechanism to its ON position when the second switch mechanism is in its ON position. In a preferred embodiment, the first and second switch mechanisms include first and second manually operable switch handles, and the interlock mechanism is interconnected between the first and second switch handles. In a preferred form, each switch mechanism is adapted for removable mounting to the electrical panel. The interlock mechanism includes a support structure adapted for engagement with the first and second switch mechanisms. A first interlock member is movably mounted on the support structure, and is engaged with the first switch handle for movement therewith in the first direction. A second interlock member is also movably mounted to the support structure, and is engaged with the second switch handle for movement therewith in the second direction. The first and second interlock members include interference structure to prevent movement of the second switch member to an ON position when the first switch member is in its ON position, and for preventing the movement of the first switch member to an ON position when the second switch member is in its ON position.

The interference structure of the first and second interlock members preferably includes structure defining a notch. The notch is formed in one of the interlock members, hereafter referred to as the notched interlock member, and extends in a direction transverse to the direction of movement of the notched interlock member. The other interlock member is preferably in the form of an engagement interlock member having corresponding interference structure adapted to be selectively received within the notch. When the first switch member, to which the notched interlock member is mounted, is moved to its OFF position, the notch is aligned with the interference structure of the engagement interlock member. This enables movement of the second switch member, to which the engagement interlock member is mounted, to its ON position. Preferably, the notched interlock member defines an interference surface adjacent the notch which is in alignment with the interference structure of the engagement interlock member. Movement of the second switch member to its ON position is prevented by the interference structure when the first switch member, to which the notched interlock member is mounted, is in its ON position.

The support structure preferably includes a support plate configured to engage a shoulder defmed by each of the first and second switch mechanisms adjacent to the first and second switch members, respectively. A post member is engaged with and extends from the support plate, and the first and second interlock members each include a slot extending in the direction of its movement. The post member is received within the slots for providing movement of the first and second interlock members relative to the support plate. Each interlock member is preferably formed of a planar member slidably mounted to the support plate for movement relative to each other.

Another aspect of the invention involves an improvement in an electrical panel including a first switch mechanism having a first switch member or handle movable in a first direction between an ON and an OFF position for controlling the supply of electrical power from a first source. The improvement contemplates a second switch mechanism having a second switch member or handle movable in a second direction, transverse to the first direction, for controlling the supply of power from a second power source, and an interlock mechanism for controlling movement of the first and second switch members or handles. Details of this aspect of the invention are substantially as summarized above.

The invention further contemplates a method of preventing movement of a first switch mechanism to an ON position when an adjacent second interlock mechanism is in an ON position, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
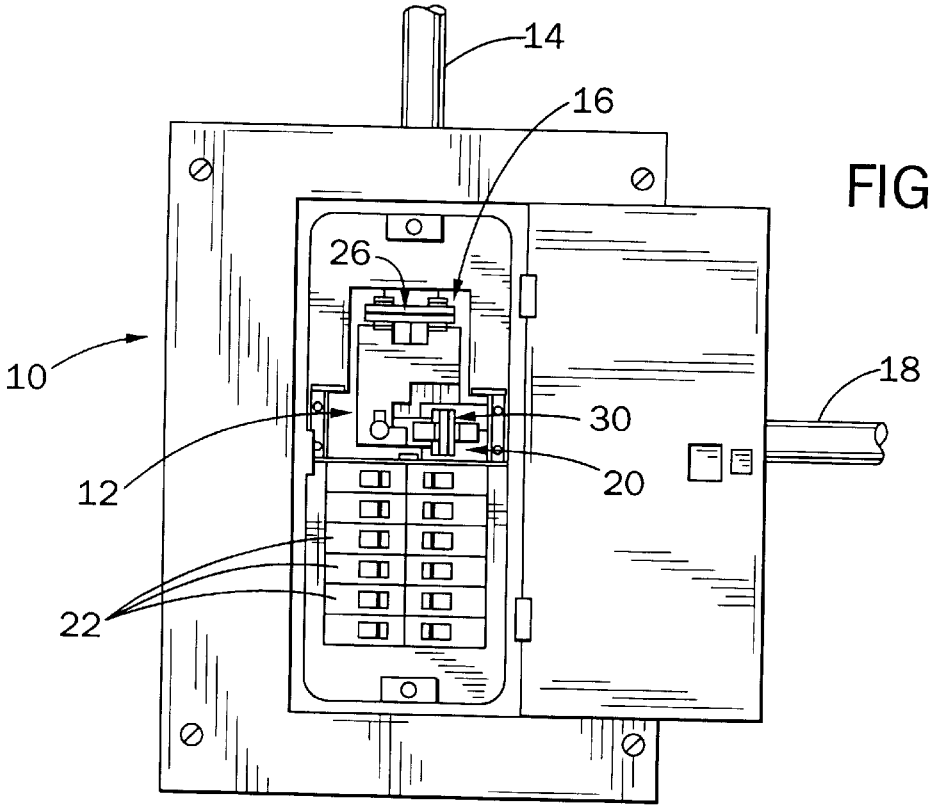
FIG. 1 is a front elevational view of a load center panel having an array of circuit breakers, at least one pair of which is interconnected by the interlock mechanism embodying the present invention.

FIG. 1 illustrates an electrical panel assembly 10 incorporating the interlock mechanism of the invention, shown generally at 12. A primary source of electrical power, such as utility power, is supplied to electrical panel assembly 10 through a conduit 14, and electrical panel assembly 10 includes a primary switch mechanism 16 which is interconnected with the primary source of electrical power, for controlling the supply of electrical power to electrical panel assembly 10 from the primary electrical power source. A secondary source of electrical power, such as from a generator, is supplied to electrical panel assembly 10 through a conduit 18. Electrical panel assembly 10 incorporates a secondary switch mechanism 20 interconnected with the secondary electrical power source, for controlling the supply of electrical power to electrical panel assembly 10 from the secondary electrical power source. A series of branch circuit breakers 22 are incorporated into electrical panel assembly 10, for controlling the supply of electrical power from either primary switch mechanism 16 or secondary switch mechanism 20 to the various electrical circuits of the building in which electrical panel assembly 10 is mounted, in a manner as is known.

Apart from interlock mechanism 12, electrical panel assembly 10 is of conventional construction, and may incorporate a standard, commercially available electrical load center such as is available from Siemens Energy & Automation, Inc. of Tucker, Ga. (Siemens) under its designation G4040MB1200CU, although it is understood that any other similar component may be employed. Primary switch mechanism 16 may be that such as is available from Siemens under its designation EQ9685, and secondary switch mechanism 20 may be that such as is available from Siemens under its designation Q230. Again, it is understood that other similar components may be employed.

Figure 2:
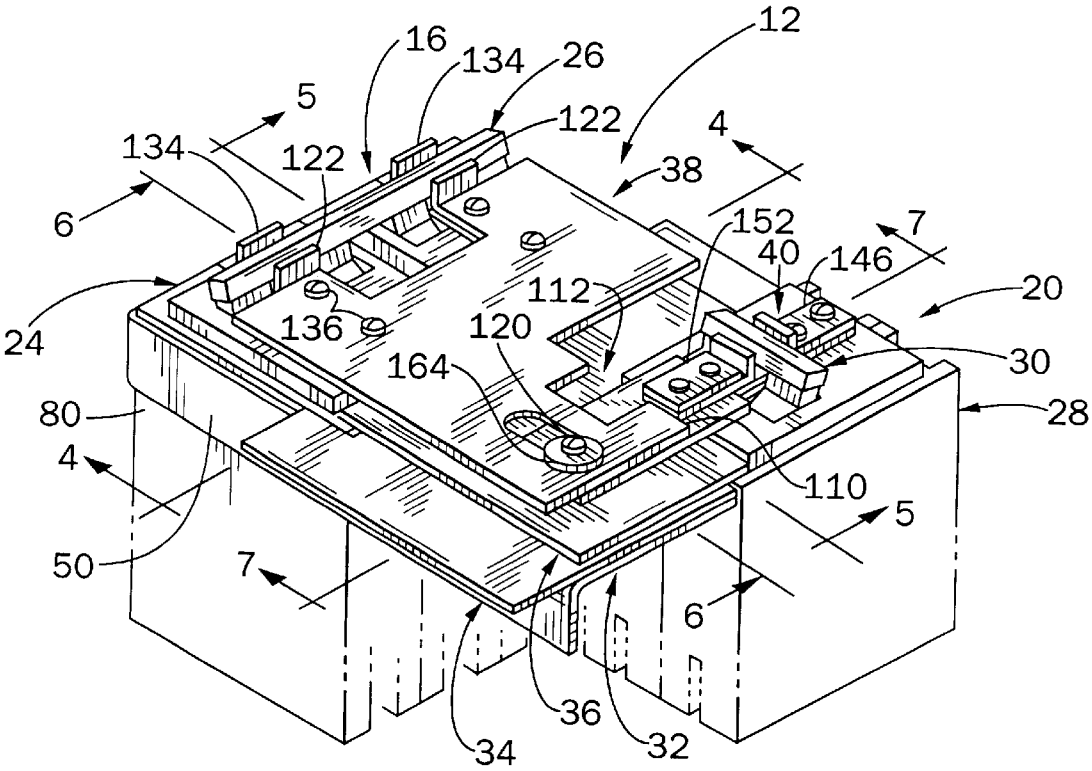
FIG. 2 is an isometric view of the interlock mechanism of the invention interposed between two transversely oriented circuit breakers in the load center panel of FIG. 1, in which a first one of the circuit breakers is in an ON position and a second one of the circuit breakers is in an OFF position.
Figure 3:
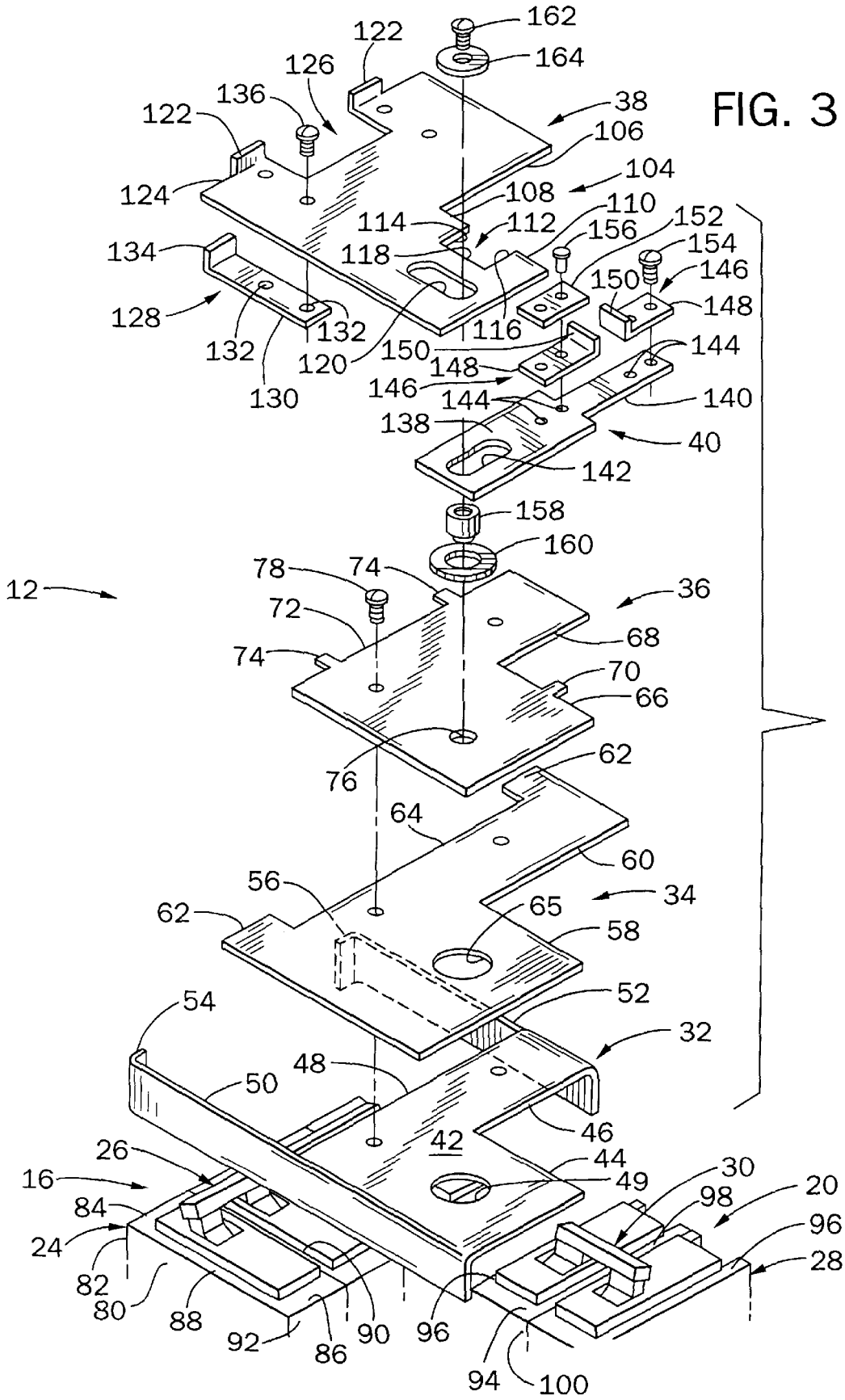
FIG. 3 is an exploded isometric view of the interlock mechanism of FIG. 2.
Figure 4:
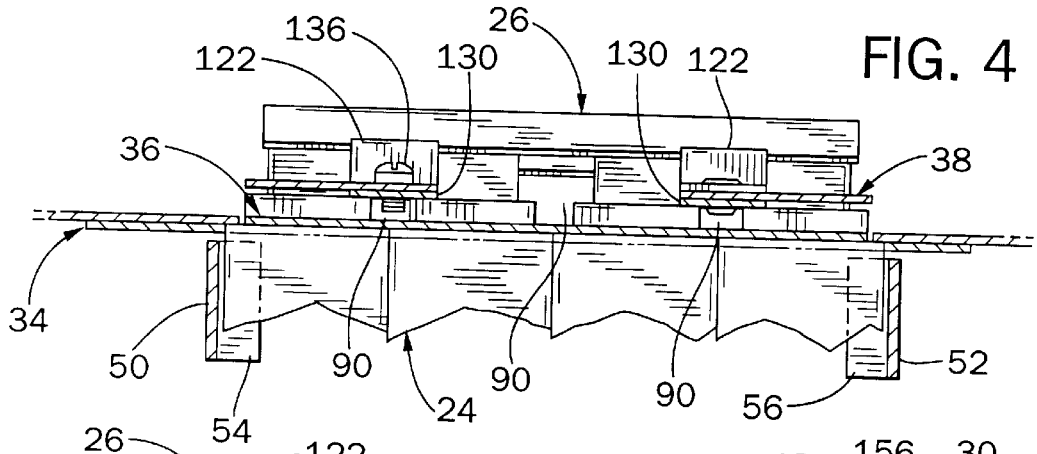
FIG. 4 is a partial sectional view taken on line 4—4 of FIG. 2.

Referring to FIGS. 1–3, primary switch mechanism 16 includes a switch body, shown generally at 24, and a primary switch handle 26 movably mounted to body 24. Primary switch mechanism 16 is mounted toward the top end of electrical panel assembly 10, in a manner such that its handle 10 is movable in a direction parallel to the longitudinal axis of electrical panel assembly 10, i.e. in an upward and downward direction with reference to FIG. 1. Primary switch handle 26 is movable between an ON position in which electrical power is supplied to electrical panel assembly 10 from the primary source of electrical power, and an OFF position for cutting off the supply of electrical power to electrical panel assembly 10. In FIG. 2, primary switch handle 26 is shown in its ON position. Similarly, secondary switch mechanism 20 includes a switch body 28 and a secondary switch handle 30 movably mounted to body 28. The panel bus of electrical panel assembly 10 is constructed such that secondary switch mechanism 20 is mounted perpendicularly to primary switch mechanism 16. Secondary switch handle 30 is movable relative to switch body 28 in a direction perpendicular to the direction of movement of primary switch handle 26. Secondary switch handle 30 is movable between an ON position for supplying power to electrical panel assembly 10 from the secondary source of electrical power, and an OFF position for cutting off power from the secondary power source. In FIG. 2, switch handle 30 of secondary switch mechanism 20 is shown in its OFF position.

FIG. 2 illustrates the assembled components of interlock mechanism 12 as mounted to primary switch mechanism 16 and secondary switch mechanism 20, and FIG. 3 illustrates switch mechanisms 16, 20 and the components of interlock mechanism 12 in exploded fashion. In a manner as will be explained, interlock mechanism 12 is operable to prevent primary and secondary switch handles 26, 30, respectively, from both being in the ON position at the same time, so as to ensure that electrical panel assembly 10 is supplied with electrical power from only one source. In this manner, interlock mechanism 12 is operable to prevent the adverse consequences which may result if both primary switch mechanism 16 and secondary switch mechanism 20 are simultaneously in an ON condition.

Generally, interlock mechanism 12 includes a stationary mounting assembly incorporating a mounting member 32, an intermediate plate 34 located vertically above mounted member 32, and an upper plate 36 located vertically above intermediate plate 34, together with a movable notched interlock member 38 and a movable engagement interlock member 40.

Mounting member 32 includes an upper planar portion 42 which defines a lower longitudinal edge 44 and a lower transverse edge 46, which extends perpendicularly to longitudinal edge 44 across approximately half the width of upper planar portion 42. Upper planar portion 42 further defines an upper transverse edge 48 extending parallel to lower transverse edge 46 across the entire width of upper planar portion 42. An opening 49 is formed in upper planar portion 42 inwardly of lower longitudinal edge 44. A pair of arms 50, 52 are formed integrally with upper planar portion 42 of mounting member 32. Arms 50, 52 extend upwardly from upper planar portion 42, and terminate in inwardly extending lips 54, 56, respectively. Mounting member 32 may be a stamped and bent member formed of a any satisfactory material such as steel or aluminum, although it is understood that other materials or forming methods may be employed.

Intermediate plate 34 is a generally planar member, defining a lower longitudinal edge 58 and a lower transverse edge 60 oriented at right angles to each other. Intermediate plate 34 further defmes a pair of upwardly extending ears 62 and a transverse edge 64 extending therebetween parallel to lower transverse edge 60. An opening 65 is formed in intermediate plate 34 inwardly of lower longitudinal edge 58. Again, intermediate member 34 may be a stamped member formed of any satisfactory material such as steel or aluminum, although it is understood that other materials or forming methods may be employed.

Upper plate 36 is also a generally planar member, and includes a lower longitudinal edge 66 and a lower transverse edge 68 oriented at right angles to each other. A tab 70 extends outwardly from lower longitudinal edge 66. Intermediate plate 36 further defines an upper transverse edge 72 extending parallel to lower transverse edge 68. A pair of tabs 74 extend outwardly from upper transverse edge 72. An opening 76 is formed in upper plate 36 inwardly of longitudinal edge 66. Upper plate 36 may be a stamped member formed of any satisfactory material such as steel or aluminum, although it is again understood that other materials or forming methods may be employed.

As noted above, mounting member 32, intermediate plate 34 and upper plate 36 make up a mounting subassembly secured together by means of a pair of fasteners, one of which is shown at 78, extending through aligned openings in mounting member 32, intermediate plate 34 and upper plate 36. The opening in mounting member 32 is preferably threaded, so as to receive the threads of fastener 78. When mounting member 32, intermediate plate 34 and upper plate 36 are assembled together, openings 49 and 65 on mounting member 32 and intermediate plate 34, respectively, are in alignment with each other, and opening 76 in upper plate 36 is in alignment with openings 49 and 65.

The mounting subassembly made up of mounting member 32, intermediate plate 34 and upper plate 36 is engaged with primary switch mechanism 16 and secondary switch mechanism 20 by placing arms 50, 52 of mounting member 32 one on either side of primary switch mechanism body 24, such that arm 50 extends along a first side of body 24, shown at 80, and arm 52 extends along the side of body 24 opposite side 80. Lips 54, 56 are placed into engagement with the end of primary switch mechanism body 24, shown at 82.

Figure 5:
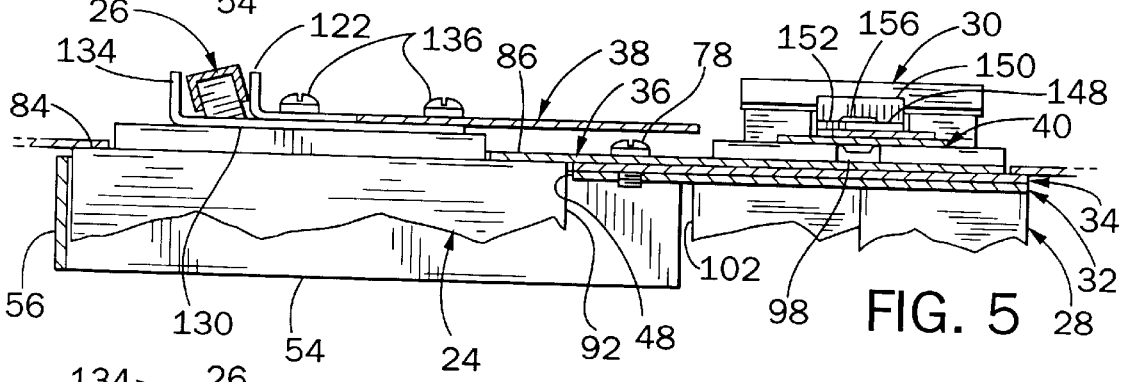
FIG. 5 is a partial sectional view taken on line 5—5 of FIG. 2.
Figure 6:
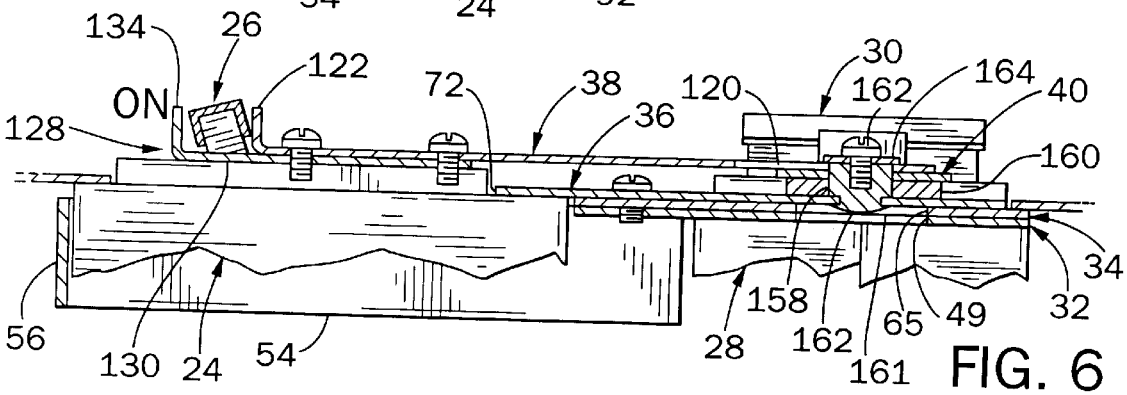
FIG. 6 is a partial sectional view taken on line 6—6 of FIG. 2.

Referring to FIG. 3, primary switch mechanism body 24 further defines an upper shoulder 84 and a lower shoulder 86 which are parallel to each other. A pair of end shoulders, one of which is shown at 88, extend between upper and lower shoulders 84, 86, respectively, and a series of internal channels 90 extend parallel to end shoulders 88 between upper and lower shoulders 84, 86, respectively. As shown in FIGS. 5 and 6, mounting member 32 is positioned such that its upper transverse edge 48 is located adjacent the lower end of primary switch mechanism body 24, shown at 92, adjacent lower shoulder 86.

Figure 7:
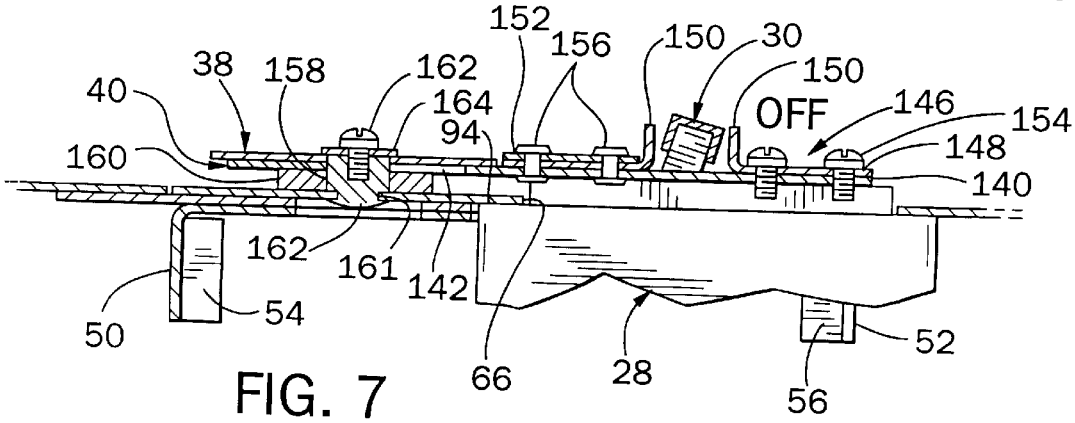
FIG. 7 is a partial sectional view taken on line 7—7 of FIG. 2.

In a similar mainer, secondary switch mechanism body 28 defines an inner shoulder 94, a pair of transverse outer shoulders 96 and a channel 98 extending outwardly from inner shoulder 94 between outer shoulders 96. As shown in FIG. 7, lower longitudinal edge 44 of mounting member 32 is located adjacent the inner end of primary switch mechanism body 28, shown at 100, below inner shoulder 94, and lower transverse edge 46 of mounting member 32 is located adjacent the upper sidewall of primary switch mechanism body 28, shown in FIG. 5 at 102, below upper outer shoulder 96.

When assembled to mounting member 32, intermediate plate 34 is positioned such that its upper transverse edge 64 is in alignment with upper transverse edge 48 of mounting member 32. Similarly, lower longitudinal edge 58 and lower transverse edge 60 of intermediate plate 34 are in alignment with lower longitudinal edge 44 and lower transverse edge 46, respectively, of mounting member 32. Ears 62 of intermediate plate 34 are located outwardly of the end shoulders, such as 88, of primary switch mechanism body 24.

When mounted to intermediate plate 34 and mounting member 32, upper plate 36 is positioned such that its upper transverse edge 72 overlies lower shoulder 86 defined by primary switch mechanism body 24, and its longitudinal edge 66 overlies inner shoulder 94 defined by secondary switch mechanism body 28. Transverse tab 70 extending from longitudinal edge 66 extends into channel 98 defined by secondary switch mechanism body 28, and longitudinal tabs 74, which extend from upper transverse edge 72, extend into channels 90 defined by primary switch mechanism body 24. In this manner, the lateral position of the mounting assembly defined by mounting member 32, intermediate plate 34 and upper plate 36 is fixed relative to primary and secondary switch mechanisms 16, 20, respectively, by arms 50, 52 and the associated lips 54, 56, respectively, in combination with engagement of tabs 70 and 74 within channels 98 and 90, respectively. Relative downward vertical movement is prevented by engagement of upper plate 36 with shoulders 86 and 94 defined by primary and secondary switch mechanism bodies 24 and 28, respectively.

Referring to FIG. 3, notched interlock member 38 is a substantially planar member, and a cut-out 104 is formed at its lower end. Cut-out 104 is defmed by a transverse edge 106 in combination with an end edge including an inner section 108 and an outer section 110, between which a notch or recess 112 is located. Recess 112 is defmed by a pair of side edges 114, 116 extending from inner and outer end edge sections 108, 110, respectively, in combination with an end edge 118 extending therebetween.

An axially extending slot 120 is formed in notched interlock member 38, inwardly of recess 112.

Notched interlock member 38 further includes a pair of outer tabs 122 extending upwardly from an upper end edge 124. A recess 126 extends inwardly from upper end edge 124 between outer tabs 122.

A pair of bracket members, one of which is shown at 128, are adapted for engagement with notched interlock member 38 for interconnecting notched interlock member 38 with primary switch handle 26. Each bracket member 128 includes a base strip 130 having a pair of threaded openings 132 formed therein, and an upwardly extending end tab 134. As shown in FIGS. 2 and 4–6, notched interlock member 38 is mounted to handle 26 of primary switch mechanism 16 by first placing notched interlock member 38 on the outer face of primary switch mechanism body 24 such that outer tabs 122 are located adjacent the inner surface of switch handle 26. Bracket members 128 are placed below notched interlock member 38 over channels 90, and extend through an opening defined by switch handle 26 such that each bracket end tab 134 is located on the side of primary switch handle 26 opposite that of outer tabs 122. Threaded fasteners 136 extend through openings formed in notched interlock member 38 and into the threaded openings 132 in bracket members 128, for securing brackets 128 and notched interlock member 38 together. The spacing between bracket member end tabs 134 and outer tabs 122 of notched interlock member 38 is such that tabs 122 and 134 are located closely adjacent the sides of switch primary switch handle 26. In this manner, any movement of primary switch handle 26 results in movement of notched interlock member 38.

Slot 120 formed in notched interlock member 38 extends along a longitudinal axis parallel to the direction of movement of switch handle 26.

Referring to FIG. 3, engagement interlock member 40 is in the form of a planar strip defining a base 138 and a finger 140 extending from base 138. A slot 142 is formed in base 138, and extends along a longitudinal axis coincident with a longitudinal axis along which base 138 and finger 140 extend. A series of openings, shown at 144, are formed in base 138 and finger 140.

A pair of bracket members 146 are adapted for mounting to engagement interlock member 40 for interconnecting engagement interlock member 40 with secondary switch handle 30. Each bracket member 146 defines a planar base 148 and an upstanding tab 150. Openings are formed in each base 148 in alignment with openings 144 in engagement interlock member 40.

An engagement member 152 is adapted for placement over base 148 of the inner one of bracket members 146. Engagement member 152 includes a pair of openings in alignment with the openings in base 148 and the inner pair of openings 144 in engagement interlock member 40.

Engagement interlock member 40 is interconnected with secondary switch handle 30 as shown in FIGS. 2 and 7 by positioning finger 140 within an opening defined by secondary switch handle 30 such that base 138 is located inwardly of switch handle 30 and the outer end of finger 140 is positioned outwardly of switch handle 30. The outer one of bracket members 146 is then positioned over the outer pair of aligned openings 144 formed in finger 140 adjacent its outer end, and a threaded fastener 154 extends through the openings in bracket member 146 and into engagement with threads formed in the outer pair of openings 144, for mounting the outer one of bracket members 146 to the outer end of finger 140. In this manner, tab 150 of the outer one of bracket members 146 is located closely adjacent the outer surface of switch handle 30. In a similar manner, the inner one of bracket members 146 is positioned such that its tab 150 is located closely adjacent the inner surface of secondary switch handle 30. Engagement member 152 and the inner one of bracket members 146 are engaged with engagement interlock member 40 in any satisfactory manner, such as by use of a pair of rivets, one of which is shown at 156, which extend through the openings formed in engagement member 152 and base 148 of inner bracket member 146, and into the inner pair of openings 144 in engagement interlock member 40. With this construction, the inner bracket member 146 and engagement member 152 are first fixed to engagement interlock member 40, such that finger 140 can be passed through the opening defined by secondary switch handle 30, and the outer bracket member 146 is then mounted to the outer end of finger 140 as described above. Tabs 150 of bracket members 146 are located closely adjacent the sides of secondary switch handle 30, such that any movement of secondary switch handle 30 results in movement. of engagement of interlock member 40 therewith. Slot 142 in engagement interlock member 40 is oriented such that its longitudinal axis is parallel to the direction of movement of secondary switch handle 30.

In assembly, base 138 of engagement interlock member 40 is disposed between notched interlock member 38 and upper plate 36 such that slot 120 of notched interlock member 38 and slot 142 of engagement interlock member 40 overlap each other. A post 158 is mounted to upper plate 36, and extends through a spacer 160 which is sandwiched between the lower surface of engagement interlock member 40 and the upper surface of intermediate plate 36. Post 158 includes a downwardly facing shoulder, and a reduced diameter portion therebelow, shown at 161 (FIGS. 6,7), is received within openings 76 in upper plate 36. Post 158 is mounted to upper plate 36 using a standard rivet machine process which forms a head 162 on the lower end of post 158, such that head 162 has a diameter greater than that of opening 76. A threaded passage is formed in the upper end of post 158, and a threaded fastener 162 extends through a washer 164 and into the passage in post 158. Washer 164 has a diameter greater than the transverse dimension of slot 120 in notched interlock member 38, so as to secure notched interlock member 38 and engagement interlock member 40 to upper plate 36. Post 158 extends both through slot 120 in notched interlock member 38 and slot 142 in engagement interlock member 40, and guides movement of interlock members 38 and 40 in response to movement of primary and secondary switch handles 26 and 30, respectively.

Figure 8:
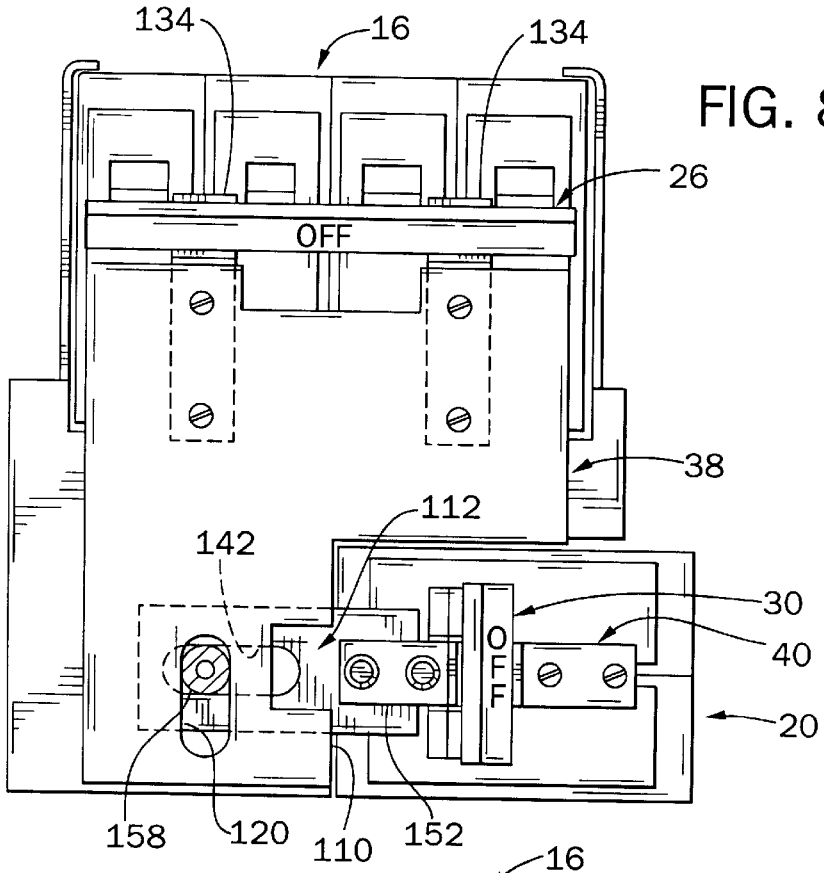
FIG. 8 is a top plan view of the interlock mechanism of FIG. 2 wherein each circuit breaker is in an OFF position.
Figure 9:
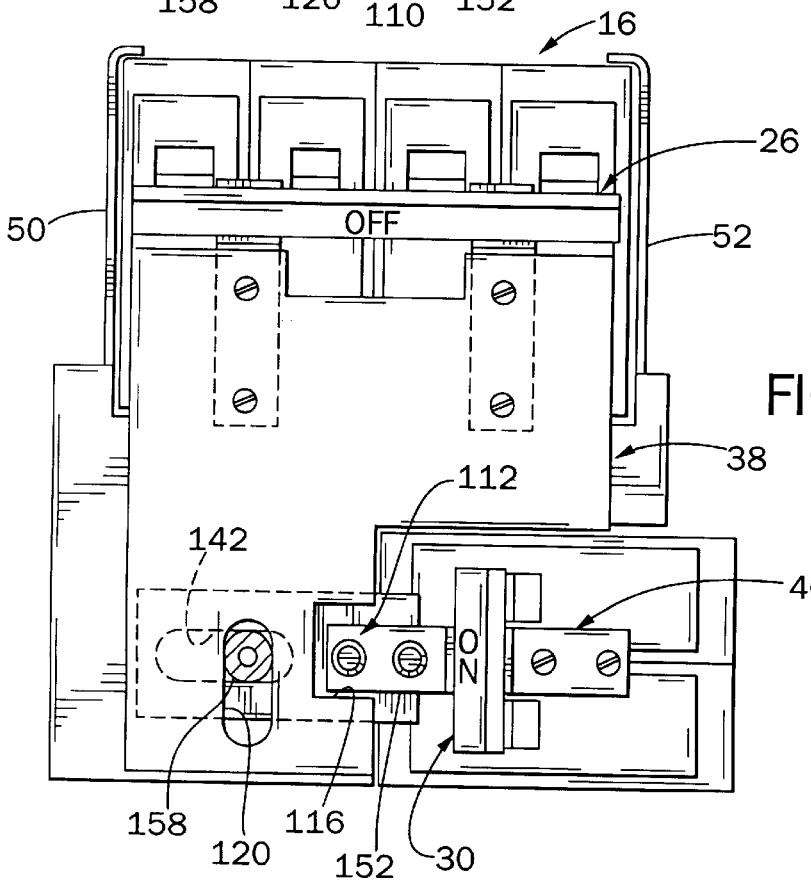
FIG. 9 is a top plan view similar to FIG. 8 showing the first circuit breaker in an OFF position and the second circuit breaker in an ON position.

In operation, interlock mechanism 12 functions as follows to prevent primary and secondary switch handles 26 and 30 from being in the ON position at the same time. With reference to FIG. 8, switch handles 26 and 30 are both illustrated as being in the OFF position. In this position, recess 112 in notched interlock member 38 is in axial alignment with engagement member 152 of engagement interlock member 40, such that secondary switch handle 30 can be moved to its ON position as shown in FIG. 9. When secondary switch handle 30 is moved to its ON position in this manner, movement of engagement interlock member 40 is enabled by the provision of slot 142 in base 138 of engagement interlock member 40, and engagement member 152 is received within recess 112 of notched interlock member 38. With secondary switch handle 30 in its ON position of FIG. 9, engagement member 152 is located in close proximity to side edge 116 of recess 112 in notched interlock member 38. Movement of primary switch handle 26 away from its OFF position is prevented by engagement of side edge 116 with engagement member 152, such that primary switch handle 26 cannot be moved to its ON position. Engagement member 152 thus defines interference structure in the path of movement of notched interlock member 38 and its associated recess 112, to prevent movement of primary switch handle 16 to its ON position as long as secondary switch handle 26 is in its ON position.

When it is desired to move primary switch handle 26 to its ON position, secondary switch handle 30 must first be moved to its OFF position as shown in FIG. 8, which moves engagement member 152 out of recess 112 in notched interlock member 38. Such movement of engagement member 152 out of recess 112 enables movement of notched interlock member 38 along with primary switch handle 26 to its ON position, as shown in FIG. 2. Movement of notched interlock member 38 along with primary switch handle 26 is enabled by the provision of slot 120 in notched interlock member 38, and results in the positioning of end edge outer section 110 of notched interlock member 38 in alignment with engagement member 152. End edge outer section 110 thus defines interference structure in the path of movement of engagement member 152, to prevent movement of secondary switch handle 30 to its ON position as long as primary switch handle 26 is in its ON position.

It can thus be appreciated that interlock mechanism 12 provides a simple and efficient mechanism for preventing two switches which are movable in perpendicular directions from being in an ON position at the same time. The components of interlock mechanism 12 are relatively inexpensive to manufacture and assemble, and take advantage of the existing switch body and handle structure to secure the components of interlock mechanism 12 to each other and to the switches. Interlock mechanism 12 can either be installed during original assembly of electrical panel assembly 10 or can be retrofit after assembly if an existing electrical panel is being outfitted with a secondary source of power.

While interlock mechanism 12 has been shown and described with respect to switch handles which move in a direction perpendicular to each other, it is understood that interlock mechanism 12 can be easily adapted to accommodate arrangements in which the direction of movement of the switch handles includes any transverse component, i.e. when the switch handles do not move along the same or parallel axes. Further, while interlock mechanism 12 has been shown and described with respect to an electrical panel assembly, it should be understood that interlock mechanism 12 could be used in any other application in which it is desired to interlock two switches or switch handles which are oriented relative to each other such that movement of the switch handles is non-parallel.

Various alternatives and embodiments are contemplated as being within the scope of the following claims particularly pointing out and distinctly claiming the subject matter regarded as the invention.

I claim:

1. An electrical panel, comprising:

a first switch mechanism movable in a first direction between an ON position and an OFF position for controlling the supply of electrical power to the electrical panel from a first power source;

a second switch mechanism movable in a second direction, non-parallel to the first direction, between an ON and an OFF position for controlling the supply of electrical power to the electrical panel from a second power source; and an interlock mechanism interconnected between the first switch mechanism and the second switch mechanism, wherein the interlock mechanism includes a first interlock member interconnected with the first switch mechanism and movable therewith between its ON and OFF positions, and a second interlock member interconnected with the second switch mechanism and movable therewith between its ON and OFF positions, wherein the first and second interlock members are movable separately from each other, and wherein the first and second interlock members include engagement surfaces which engage each other to prevent movement of the second interlock member to a position placing the second switch mechanism in its ON position when the first switch mechanism is in its ON position, and to prevent movement of the first interlock member to a position placing the first switch mechanism in its ON position when the second switch mechanism is in its ON position.

2. The electrical panel of claim 1, wherein the first and second switch mechanisms include first and second manually operable switch handles, respectively, and wherein the first and second interlock members are interconnected between the first and second switch handles, respectively.

3. The electrical panel of claim 2, wherein each switch mechanism is adapted for removable mounting to the electrical panel.

4. An electrical panel, comprising:

a first switch mechanism interconnected with the electrical panel, and including a first manually operable switch handle movable in a first direction between an ON position and an OFF position for controlling the supply of electrical power to the electrical panel from a first power source;

a second switch mechanism interconnected with the electrical panel and including a second manually operable switch handle movable in a second direction, non-parallel to the first direction, between an ON and an OFF position for controlling the supply of electrical power to the electrical panel from a second power source; and an interlock mechanism interconnected between the first switch handle and the second switch handle for preventing movement of the second switch handle to its ON position when the first switch handle is in its ON position, and for preventing movement of the first switch handle to its ON position when the second switch handle is in its ON position, wherein the interlock mechanism comprises:

support structure adapted for engagement with the first and second switch mechanisms;

a notched interlock member movably mounted to the support structure and engaged with the first switch handle and movable therewith in the first direction;

an engagement interlock member movably mounted to the support structure and engaged with the second switch handle and movable therewith in the second direction; and wherein the notched and engagement interlock members include interference structure for preventing movement of the second switch handle to its ON position when the first switch handle is in its ON position, and for preventing movement of the first switch handle to its ON position when the second switch handle is in its ON position.

5. In an electrical panel including a first switch mechanism having a first switch member movable in a first direction between an ON position and an OFF position for controlling the supply of electrical power from a first power source, the improvement comprising:

a second switch mechanism including a second switch member movable in a second direction transverse to the first direction between an ON position and an OFF position for controlling the supply of electrical power from an alternate power source; and an interlock mechanism interposed between the first and second switch mechanisms, comprising a first interlock member interconnected with the first switch member and movable therewith, and a second interlock member interconnected with the second switch member and movable therewith, wherein the first and second interlock members are located adjacent each other and are movable independently of each other, and wherein the first and second interlock members include engagement surfaces which are configured and arranged to interact with each other to prevent movement of the second switch member to its ON position when the first switch member is in its ON position, and to prevent movement of the first switch member to its ON position when the second switch member in its ON position.

6. In an electrical panel including a first switch mechanism having a first switch member movable in a first direction between an ON position and an OFF position for controlling the supply of electrical power from a first power source, the improvement comprising:

a second switch mechanism including a second switch member movable in a second direction transverse to the first direction between an ON position and an OFF position for controlling the supply of electrical power from an alternate power source; and an interlock mechanism interposed between the first and second switch mechanisms, comprising a first interlock member interconnected with the first switch member and movable therewith, and a second interlock member interconnected with the second switch member and movable therewith, wherein the first and second interlock members are configured and arranged to prevent movement of the second switch member its ON position when the first switch member is in its ON position, and to prevent movement of the first switch member to its ON position when the second switch member its ON position, wherein one of the interlock members comprises a notched interlock member including structure defining a notch extending transverse to the direction of movement of the notched interlocked member, and wherein the other of the interlock members comprises an engagement interlock member having an interference structure adapted to be selectively received within the notch.

7. The improvement of claim 6, wherein, when the switch member associated with the notched interlock member is moved to its OFF position, the notch is aligned with the interference structure of the engagement interlock member to enable movement of the switch member associated with the engagement interlock member to its ON position.

8. The improvement of claim 7, wherein the notched interlock member defines an interference surface adjacent the notch which is in alignment with the interference structure of the engagement interlock member for preventing movement of the switch member associated with the engagement interlock member to its ON position when the switch member associated with the notched interlock member is in its ON position.

9. The improvement of claim 5, wherein the first and second interlock members are movably interconnected with a support structure adapted for engagement with the first and second switch mechanisms.

10. The improvement of claim 9, wherein the support structure includes a support plate configured to engage a shoulder defined by each of the first and second switch mechanisms adjacent the first and second switch members, respectively.

11. In an electrical panel including a first switch mechanism having a first switch member movable in a first direction between an ON position and an OFF position for controlling the supply of electrical power from a first power source, the improvement comprising:

a second switch mechanism including a second switch member movable in a second direction transverse to the first direction between an ON position and an OFF position for controlling the supply of electrical power from an alternate power source; and an interlock mechanism interposed between the first and second switch mechanisms, comprising a first interlock member interconnected with the first switch member and movable therewith, and a second interlock member interconnected with the second switch member and movable therewith, wherein the first and second interlock members are configured and arranged to prevent movement of the second switch member to its ON position when the first switch member is in its ON position, and to prevent movement of the first switch member to its ON position when the second switch member in its ON position;

wherein the first and second interlock members are movably interconnected with a support structure adapted for engagement with the first and second switch mechanisms and wherein the support structure includes a support plate configured to engage a shoulder defined by each of the first and second switch mechanisms adjacent the first and second switch members, respectively; and a post member engaged with and extending from the support plate, wherein the first interlock member defines a slot extending in the first direction within which the post member is received for providing movement of the first interlock member in the first direction relative to the support plate, and wherein the second interlock member defines a slot extending in the second direction within which the post member is received for providing movement of the second interlock member in the second direction relative to the support plate.

12. A transverse direction switch interlock for first and second switch members, wherein the first switch member is movable in a first direction to an ON position and the second switch member is movable in a second direction transverse to the first direction to an ON position, comprising:

a support;

a first interlock member interconnected with the support and movable in the first direction along with the first switch member as the first switch member is moved toward its ON position;

a second interlock member interconnected with the support and movable in the second direction along with the second switch member as the second switch member is moved toward its ON position;

wherein the first and second interlock members are located adjacent each other and are movable independently of each other; and an interference surface associated with the first interlock member which interacts with the second interlock member for preventing movement of the second interlock member in the second direction when the first switch member is in its ON position, to prevent movement of the second switch member to its ON position, and wherein the first interlock member is movable along with the first switch member to a position in which the interference surface is moved out of the path of movement of the second interlock member when the first switch member is in its OFF position, for allowing movement of the second interlock member in the second direction to allow movement of the second switch member to its ON position.

13. A transverse direction switch interlock for first and second switch members, wherein the first switch member includes a first switch handle movable in a first direction to an ON position and the second switch member includes a second switch handle movable in a second direction transverse to the first direction to an ON position, wherein each switch handle defines oppositely facing sides, comprising:

a support;

a first interlock member interconnected with the support and movable in the first direction along with the first switch handle as the first switch handle is moved toward its ON position;

a second interlock member interconnected with the support and movable in the second direction along with the second switch handle as the second switch handle is moved toward its ON position; and an interference surface associated with the first interlock member for preventing movement of the second interlock member in the second direction when the first switch handle is in its ON position, to prevent movement of the second switch handle to its ON position, and for allowing movement of the second interlock member in the second direction when the first switch handle is in its OFF position, to allow movement of the second switch handle to its ON position;

wherein each interlock member includes an engagement surface located adjacent each side of the switch handle for providing movement of each interlock member with its associated switch handle.

14. The switch interlock of claim 12, wherein the interference structure comprises a planar member slidably mounted to the support relative to each other.

15. A transverse direction switch interlock for first and second switch members, wherein the first switch member is movable in a first direction to an ON position and the second switch member is movable in a second direction transverse to the first direction to an ON position, comprising:

a support;

a first substantially planar interlock member slidably interconnected with the support and movable in the first direction along with the first switch member as the first switch member is moved toward its ON position;

a second substantially planar interlock member slidably interconnected with the support and movable in the second direction along with the second switch member as the second switch member is moved toward its ON position;

an interference surface associated with the first interlock member for preventing movement of the second interlock member in the second direction when the first switch member is in its ON position, to prevent movement of the second switch member to its ON position, and for allowing movement of the second interlock member in the second direction when the first switch member is in its OFF position, to allow movement of the second switch member to its ON position; and a post interconnected with and extending from the support, wherein each interlock member includes a slot through which the post extends, and wherein the slot of the first interlock member extends in the first direction and the slot of the second interlock member extends in the second direction.

16. A transverse direction switch interlock for first and second switch members, wherein the first switch member is movable in a first direction to an ON position and the second switch member is movable in a second direction transverse to the first direction to an ON position, comprising:

a support;

a first substantially planar interlock member slidably interconnected with the support and movable in the first direction along with the first switch member as the first switch member is moved toward its ON position;

a second substantially planar interlock member slidably interconnected with the support and movable in the second direction along with the second switch member as the second switch member is moved toward its ON position;

an interference surface associated with the first interlock member for preventing movement of the second interlock member in the second direction when the first switch member is in its ON position, to prevent movement of the second switch member to its ON position, and for allowing movement of the second interlock member in the second direction when the first switch member is in its OFF position, to allow movement of the second switch member to its ON position; and wherein the first interlock member includes a notch and wherein the interference surface is located adjacent the notch, and wherein the second interlock member includes interference structure, wherein, when the first switch member is in its ON position the interference surface is in alignment with the interference structure to prevent movement of the second interlock member in the second direction to thereby prevent movement of the second switch member to its ON position, and wherein the notch is in alignment with the interference structure when the first switch member is in its OFF position so as to permit movement of the interference structure into the notch to thereby enable the second switch member to be moved in the second direction to its ON position.

17. A method of selectively preventing movement of first and second switch mechanisms which are movable in non-parallel first and second directions, comprising the steps of:

interconnecting a first interlock member with the first switch mechanism so that the first interlock member is movable with the first switch mechanism in the first direction;

interconnecting a second interlock member with the second switch mechanism so that the second interlock member is movable with the second switch mechanism in the second direction;

wherein the first and second interlock members are movable independently of each other; and providing interference structure associated with the first interlock member which is arraned to engage the second interlock member to prevent movement of the second interlock member in the second direction when the first switch member is in its ON position, to prevent movement of the second switch member to its ON position, and wherein the first interlock member is movable to a position in which the interference structure is moved out of the path of movement of the second interlock member when the first switch member is in its OFF position, to allow movement of the second interlock member in the second direction and thereby movement of the second switch member to its ON position.

18. The method of claim 17 further including the step of interconnecting a first power source with the first switch mechanism and a second power source with the second switch mechanism.

19. The method of claim 17 further including the step of providing a notch in the first interlock member for selectively engaging the interference structure.

20. A method of selectively preventing movement of first and second switch mechanisms which are movable in non-parallel first and second directions, comprising the steps of:

interconnecting a first interlock member with the first switch mechanism so that the first interlock member is movable with the first switch mechanism in the first direction;

interconnecting a second interlock member with the second switch mechanism so that the second interlock member is movable with the second switch mechanism in the second direction; and providing interference structure associated with the first interlock member for preventing movement of the second interlock member in the second direction when the first switch member is in its ON position, to prevent movement of the second switch member to its ON position, and for allowing movement of the second interlock member in the second direction when the first switch member is in its OFF position, to allow movement of the second switch member to its ON position;

wherein the steps of interconnecting the first interlock member with the first switch mechanism so that the first interlock member is movable with the first switch mechanism in the first direction, and interconnecting the second interlock member with the second switch mechanism so that the second interlock member is movable with the second switch mechanism in the second direction, are carried out by providing each of the first and second interlock members with a slot and positioning the slots in overlapping relationship; and extending a post member through the slots to allow sliding movement of the first and second interlock members relative to each other, wherein said post member is attached to a support structure.

21. An electrical panel comprising:

a first switch mechanism switchable in a first direction between an ON position and an OFF position for controlling the supply of electrical power to the electrical panel from a first power source;

a second switch mechanism switchable in a second direction, non-parallel to the first direction, between an ON position and an OFF position for controlling the supply of electrical power to the electrical panel from a second power source; and interlock means for preventing switching of the second switch mechanism to its ON position when the first switch mechanism is in its ON position, and preventing switching of the first switch mechanism to its ON position when the second switch mechanism is in its ON position, wherein the interlock means includes independently movable first and second interlock members movable with the first and second switch mechanisms, respectively, and wherein the interlock members are constructed and arranged to selectively engage each other to prevent both the first and second switch mechanisms from being in the ON position at the same time.

22. A method of selectively preventing movement of first and second switch mechanisms which are movable in non-parallel first and second directions, comprising the steps of:

interconnecting a first interlock member with the first switch mechanism so that the first interlock member is movable with the first switch mechanism in the first direction, wherein the first interlock member includes interference structure;

interconnecting a second interlock member with the second switch mechanism so that the second interlock member is movable with the second switch mechanism in the second direction, wherein the second interlock member includes a notch;

wherein the interference structure of the first interlock member is received within the notch of the second interlock member when the first switch mechanism is in its ON position, to prevent movement of the second switch member to its ON position, and wherein the interference structure of the first interlock member is removed from the notch of the second interlock member when the first switch mechanism is in its OFF position, to allow movement of the second interlock member and thereby movement of second switch mechanism to its ON position.

* * * * *